US006253973B1

(12) United States Patent
Jones

(10) Patent No.: US 6,253,973 B1
(45) Date of Patent: Jul. 3, 2001

(54) HAT SHAPING ARRANGEMENT

(76) Inventor: Roger Jones, 9325 Kelly La., Alvarado, TX (US) 76009

( * ) Notice: Subject to any disclaimer, the term of this patent is extended or adjusted under 35 U.S.C. 154(b) by 0 days.

(21) Appl. No.: 09/545,341

(22) Filed: Apr. 7, 2000

(51) Int. Cl.[7] ..... A41H 5/02

(52) U.S. Cl. ..... 223/67; 223/24; 223/25; 223/57

(58) Field of Search ..... 223/67, 66, 57, 223/52, 24, 25, 84

(56) References Cited

U.S. PATENT DOCUMENTS 2,667,291 * 1/1954 Petrich ..... 223/66
2,921,727 * 1/1960 Lopez ..... 223/67
3,465,927 * 9/1969 Belokin, Jr. ..... 223/67
3,777,951 * 12/1973 Newsteder ..... 223/67

* cited by examiner

*Primary Examiner*—Bibhu Mohanty
(74) *Attorney, Agent, or Firm*—Kilpatrick Stockton LLP

(57) ABSTRACT

A hat shaping arrangement. The hat shaping arrangement comprises an inflation assembly and a inflatable bladder assembly. The bladder assembly has an air receiving space, an air port, and a deflated state. The bladder assembly is configured to substantially conform to an interior circumference of a hat to be shaped when the bladder assembly is in said deflated state. The inflation assembly is in fluid communication with the air receiving space through the air port. The inflation assembly is adapted to selectively input air pressure to and release air pressure from the air receiving space through the air port to inflate the bladder assembly toward conformance with an interior surface of the hat and deflate the bladder assembly away from conformance with the interior surface of the hat to be shaped thereby facilitating the retention of the shape of the hat.

22 Claims, 6 Drawing Sheets

HAT SHAPING ARRANGEMENT

TECHNICAL FIELD

The present invention relates generally to hat shaping arrangements, and more specifically to inflatable arrangements that ease installation and removal of a baseball-styled cap.

BACKGROUND ART

Head gear commonly known as baseball caps is often worn during play and other athletic activities during which this piece of wearing apparel is apt to be soiled. Once this soiling happens, it is necessary to launder the cap to rehabilitate it back toward its original condition. If washed by conventional means, it is necessary not only to dry the cap after laundering, but to also properly shape the cap during the drying process. The shaping is not only pertinent to the body of the cap, but can be equally important with respect to the bill of the cap. Currently, no adequate products meet this need, especially not for the consumer markets.

In view of the above described deficiencies associated with the use of known designs for hat drying products, the present invention has been developed to alleviate these drawbacks and provide further benefits to the user. These enhancements and benefits are described in greater detail herein below with respect to several alternative embodiments of the present invention.

DISCLOSURE OF THE INVENTION

The present invention in its several disclosed embodiments answers the needs described above with respect to hat shaping arrangements, particularly with respect to shaping arrangements for baseball-styled caps, and further incorporates additionally beneficial features. The present invention provides a product suitable for consumer markets and can be readily used even in residential settings for drying and shaping baseball-style caps that have become wet either because of their use or because of their being laundered.

Generally, the present invention is a hat shaping arrangement including an inflation assembly and an inflatable bladder assembly. The bladder assembly contains an air receiving space and an air port. In its deflated state, the bladder assembly substantially conforms to the interior circumference of a hat to be shaped. The inflation assembly is connected to the air receiving space through the air port. The inflation assembly is used to input air pressure to the air receiving space through the air port to extend the bladder assembly toward conformance with the inside of the hat to be shaped; thereby facilitating the retention of the shape of the hat. The inflation assembly is also used to release air pressure from the air receiving space through the air port allowing the bladder assembly to deflate away from conformance with the inside of the hat to be shaped.

In a preferred embodiment a substantially airtight air receiving space is formed between a semi-rigid, dome-shaped underlying form and an elastic bladder membrane. In that embodiment, a piston and cylinder manual inflation assembly is used to inflate and deflate the bladder assembly. A pressure relief value is included for expediting deflation.

In another embodiment, a securing clip is configured for releasably securing the hat. Typically, the hat will be secured at the bill. The securing clip includes at least one operating member adapted to transition the clip between open and closed configurations through use of a biasing spring that urges the clip to a normally closed state. In a further embodiment a support structure is incorporated into the hat shaping arrangement. In one configuration the support structure is a base. In another configuration, the support structure is a brace bar and a stand. In each of these configurations, the support structure includes features for supporting the inflation assembly.

In one approach to creating the air receiving space, the bladder membrane is secured to the underlying form using a securing strand and a groove receiver. In another alternative for securing the bladder membrane to the underlying form to create a substantially airtight air receiving space, a receiving groove is defined in the peripheral portion of the underlying form. In each of theses alternatives, a securing strand is configured to fit snugly within the groove receiver/receiving groove, with the bladder membrane secured between the securing strand and the groove receiver/receiving groove. In a final embodiment, the bladder assembly includes a non-inflatable underlying form and a separately inflatable overlying bladder.

MODE(S) FOR CARRYING OUT THE INVENTION

Figure 1:
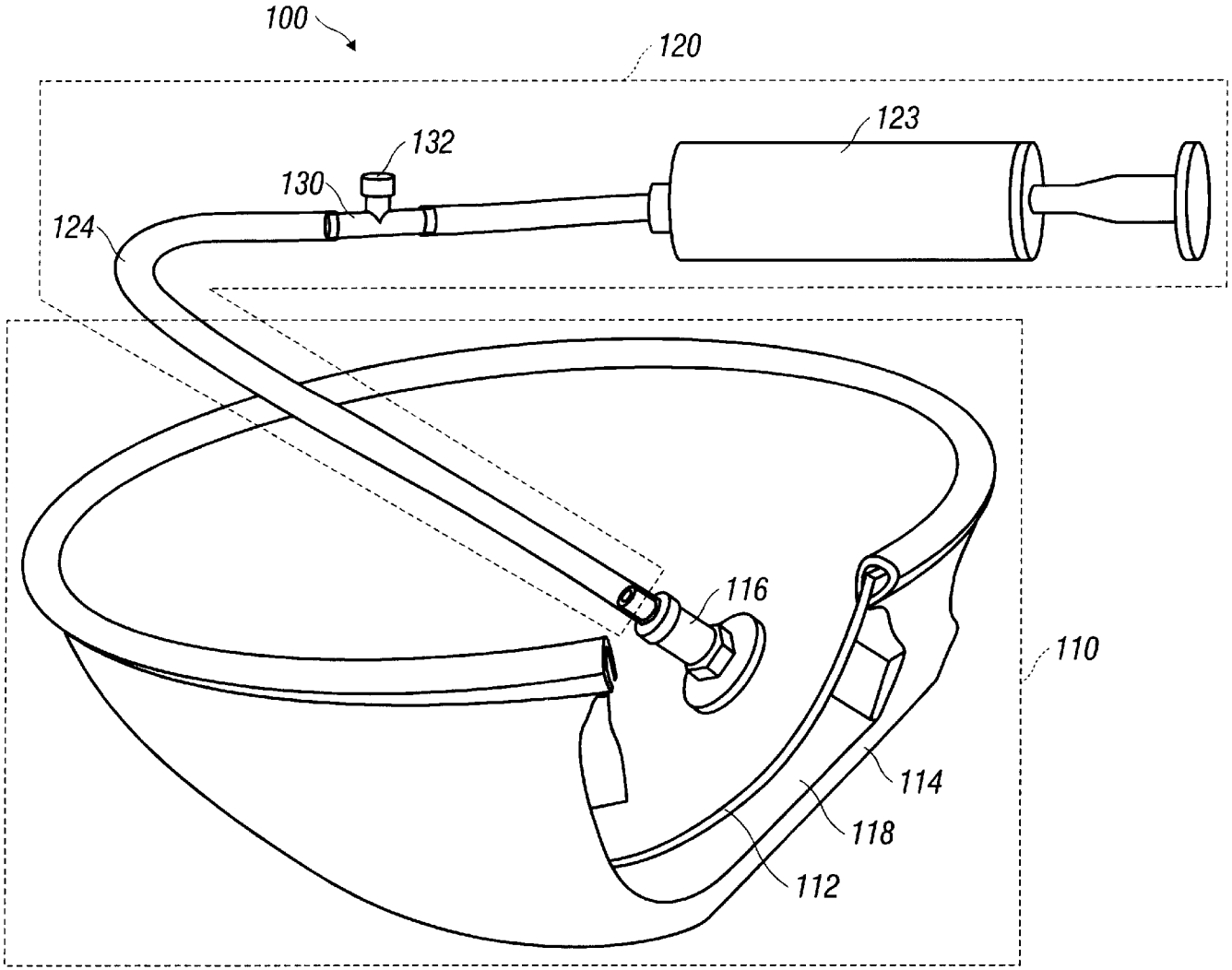
FIG. 1 is a perspective view of a preferred embodiment of the hat shaping arrangement of the present invention, including a cut-away portion and two spacers. Neither the cut-away portion nor the two spacers are part of the invention, but are included to illustrate air receiving space established between the bladder membrane and the underlying form.

As required, this application discloses detailed embodiments of the present invention; however, it is to be understood that the disclosed embodiments are merely exemplary of the invention that may be embodied in various and alternative forms. The figures are not necessarily to scale. Some features may be exaggerated or reduced to show details of particular components. Therefore, specific structural and functional details disclosed herein are not to be interpreted as limiting, but merely as a basis for the claims and as a representative basis for teaching one skilled in the art to variously employ the present invention.

Referring to the figures, in its broadest embodiment the hat shaping arrangement 100 of the present invention consists of an inflation assembly 120 and an inflatable bladder assembly 110. Being inflatable, the bladder assembly 110 contains an air receiving space 118 and an air port 116. In its deflated state, the bladder assembly 110 substantially conforms to the interior circumference 210 of a hat 200 to be shaped. The inflation assembly 120 is connected to the air receiving space 118 through the air port 116. The inflation assembly 120 is used to input air pressure to the air receiving space 118 through the air port 116 to extend the bladder assembly 110 toward conformance with the inside of the hat 200 to be shaped; thereby facilitating the retention of the shape of the hat 200. The inflation assembly 120 is also used to release air pressure from the air receiving space 118 through the air port 116 allowing the bladder assembly 110 to deflate away from conformance with the inside of the hat 200 to be shaped.

In a preferred embodiment illustrated in FIG. 1, the inflatable bladder assembly 110 includes an underlying from 112 and an overlying bladder membrane 114. The bladder assembly 110 has two end states, i.e., deflated and fully inflated, along with a continuum of inflated states between these end states. In the embodiment illustrated in FIG. 1 and FIG. 2, the underlying from 112 is configured to substantially conform to the interior circumference 210 of a hat 200. The overlying bladder membrane 114 is adapted to fit substantially conformal over the underlying from 112 when the bladder assembly 110 is deflated. The underlying from 112 and bladder membrane 114 are connected to each other to define an air receiving space 118 between them. The air receiving space 118 is substantially airtight other than at the air port 116.

Figure 2:
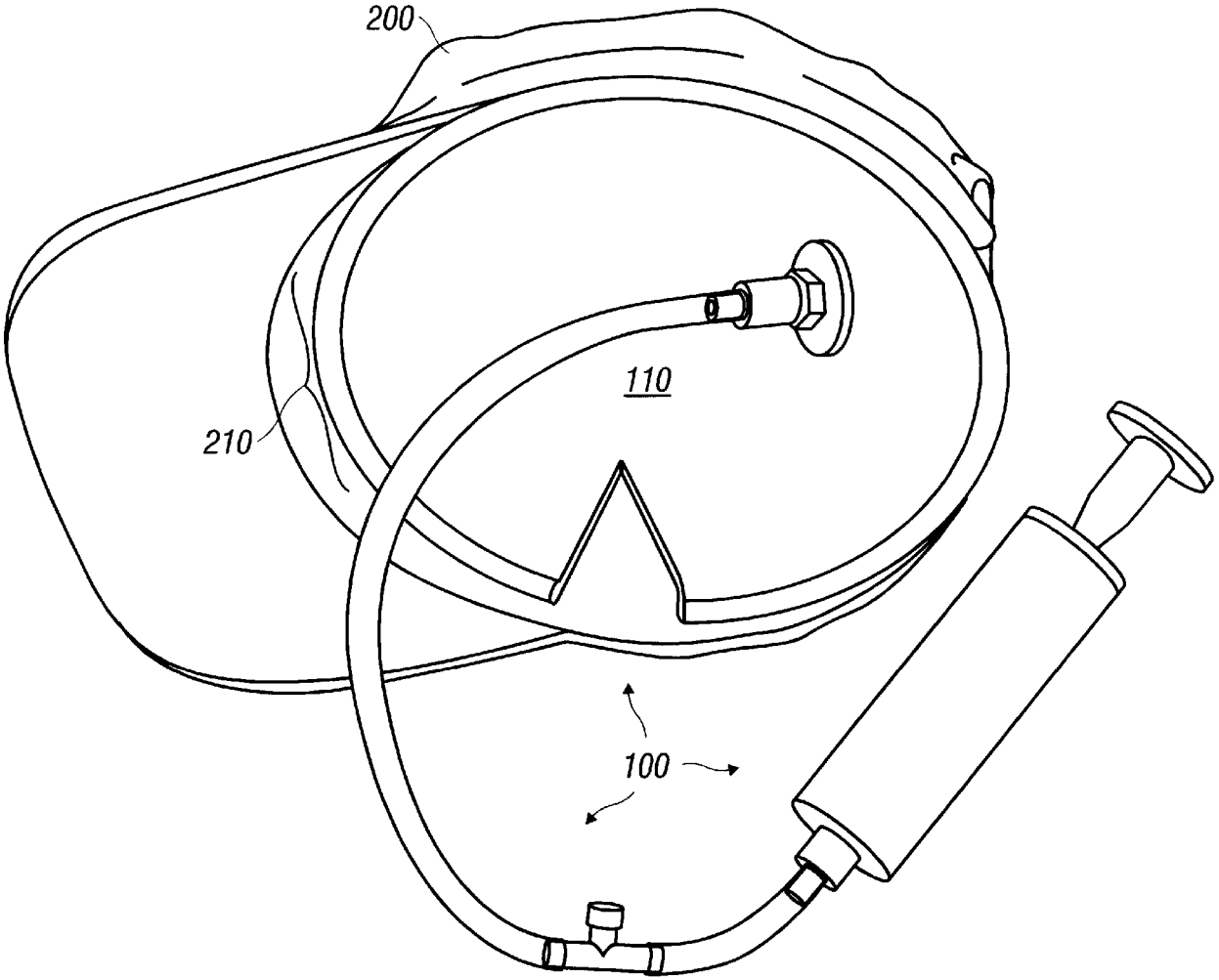
FIG. 2 is a perspective view of a preferred embodiment of the present invention in its deflated state with a hat installed thereon; the cut-away portion is not part of the current invention, but corresponds to the cut-away portion shown in FIG. 1.

In the embodiment illustrated in FIG. 1 and FIG. 2, the underlying from 112 is dome-shaped and constructed from semi-rigid plastic, which is semi-yielding, for avoiding puncture damage to the overlying bladder membrane 114. The overlying bladder membrane 114 is constructed from elastic material capable of stretching between the inflated and deflated end states. In this embodiment, the inflation assembly 120 is a manual piston and cylinder arrangement 123 interconnected with the air inlet through a conduit 124. A pressure relief valve 130, is installed in the conduit 124 for controlling retention and release of air from the air receiving space 118. Release and retention of air pressure is controlled by rotating a valve member 132. The pressure relief valve 130 may be installed at other locations, such as on the underlying from 112. By using a manual piston and cylinder arrangement 123, not only is a lesser expensive construction enabled, but the simple operation and minimization of moving parts make the resulting product highly suitable for consumer use.

Figure 3:
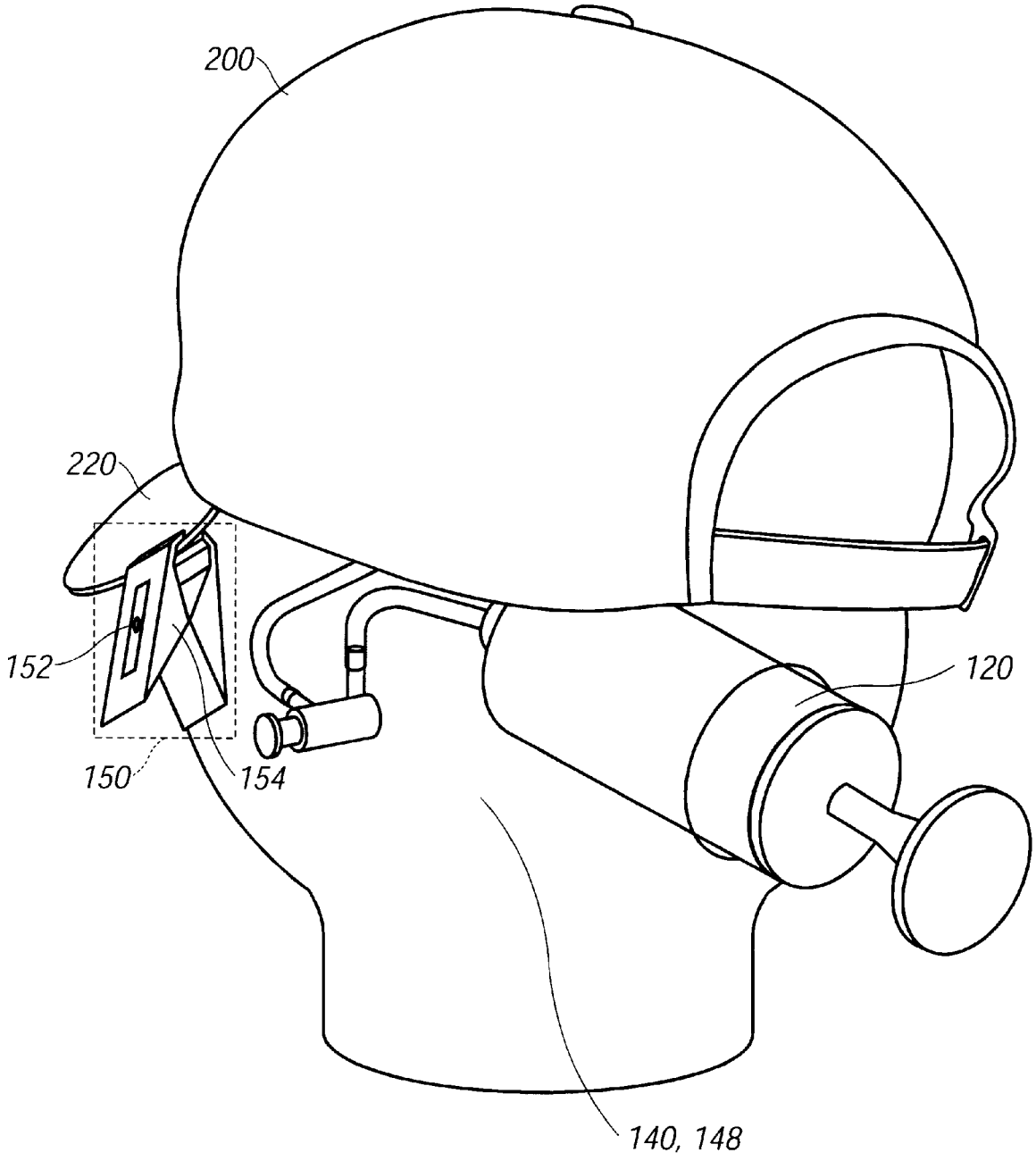
FIG. 3 is perspective view of a preferred embodiment of the present invention with a hat installed thereon, illustrating a base support structure and a securing clip.

FIG. 3 illustrates the integration of a securing clip 150 into the invention. The securing clip 150 is configured for releasably securing the hat 200 to be shaped on the hat shaping arrangement 100. The securing clip 150 includes at least one operating member 154 adapted to transition the clip 150 between open and closed configurations through use of a biasing spring 152 that urges the clip 150 to a normally closed state. In FIG. 3, the securing clip 150 is configured to secure the bill 220 of the hat 200 to the hat shaping arrangement 100.

Figure 4:
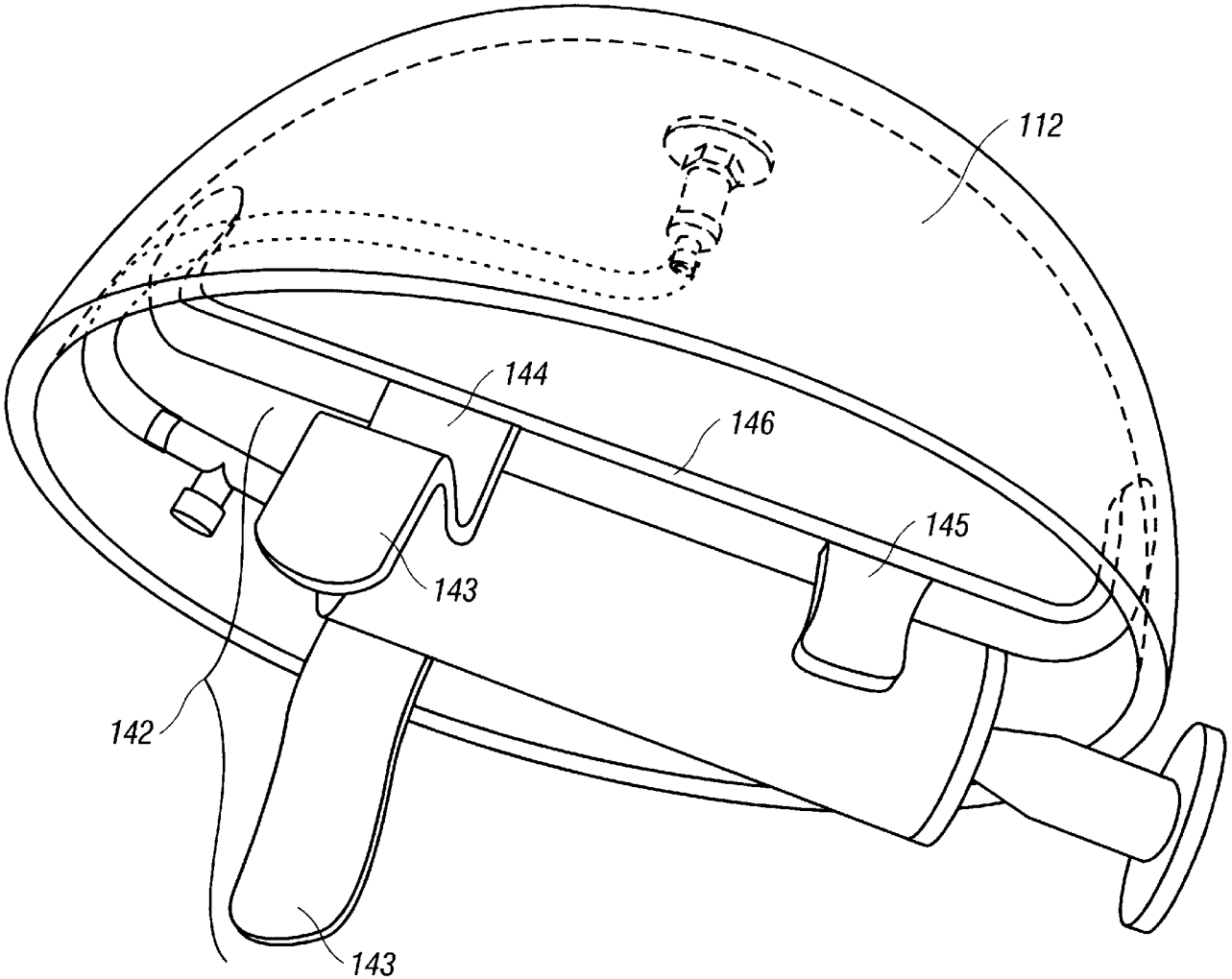
FIG. 4 is a perspective view of a partially disassembled embodiment of the present invention illustrating a brace bar and stand as support structure in highlight.

Both FIG. 3 and FIG. 4 illustrate the incorporation of a support structure into the hat shaping arrangement 100. In FIG. 3, the support structure is a base 148 also adapted to support the inflation assembly 120. In FIG. 4, the support structure consists of a brace bar 146 and a stand 142. The brace bar 146 extends from a first interior side of the underlying form 112 to a second interior side of the underlying form 112 in the manner of a chord. In the embodiment illustrated in FIG. 3, the stand 142 extends from the brace bar 146 and is configured with two foot portions 143. Single-foot stand 142 portions are also contemplated. The two-foot configuration of the support structure 140 stand 142 portion shown in FIG. 3 is adapted to form a first inflation assembly clip 144 which is used to retain the inflation assembly 120 along with a second inflation assembly clip 145 also attached to the brace bar 147.

Figure 5:
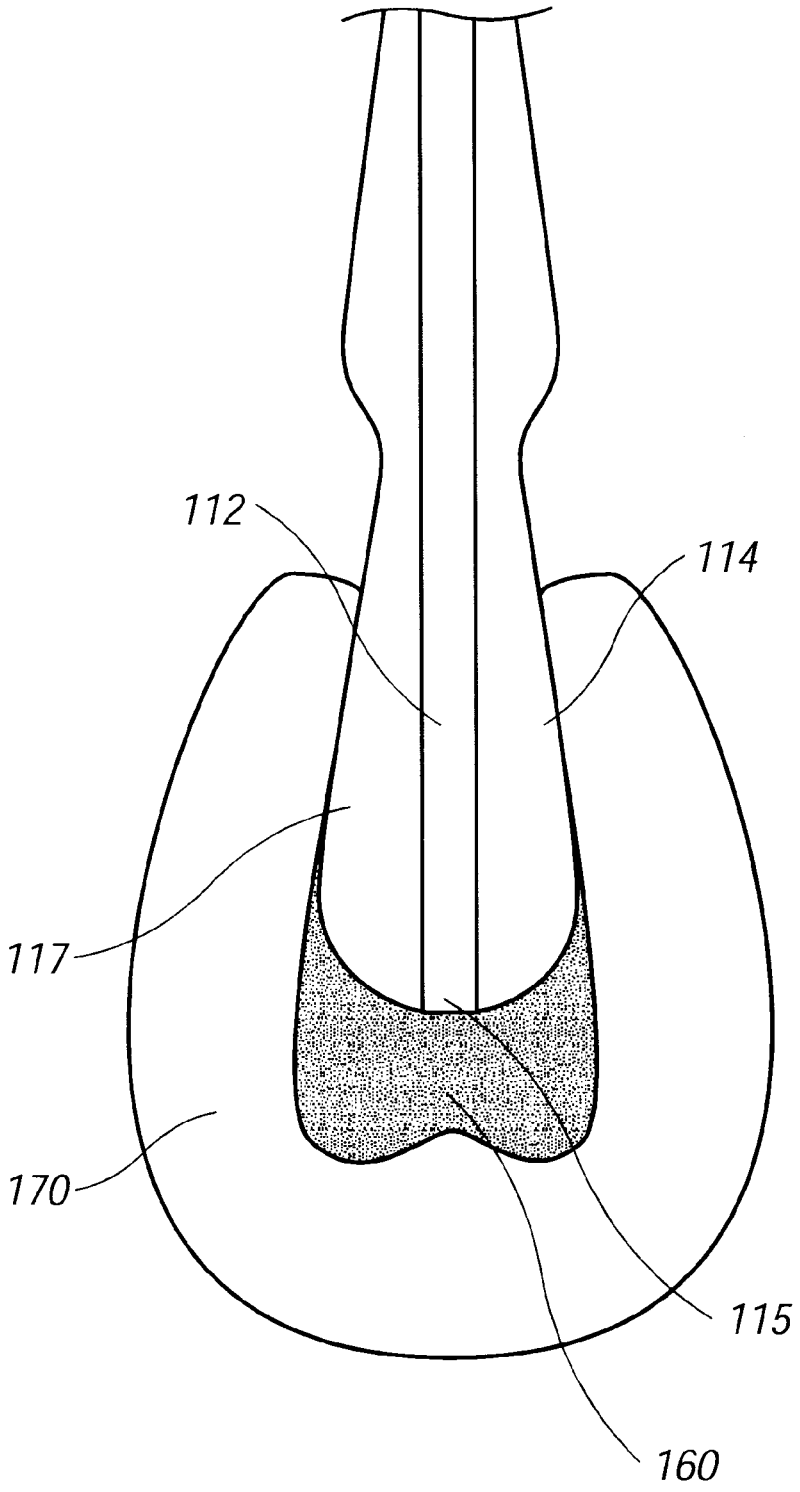
FIG. 5 is a cross section detail of a preferred embodiment of the invention where the bladder membrane is secured to the underlying form using a securing strand and a groove receiver.

FIG. 5 illustrates a preferred embodiment of the invention where the bladder membrane 114 is secured to the underlying from 112 using a securing strand 160 and a groove receiver 170. In this securing arrangement, the bladder membrane 114 is draped over the underlying from 112 so that the bladder membrane peripheral portion 117 extends beyond the edge 115 of the underlying from 112. The groove receiver 170 is adapted to snugly contain the edge 115 of the underlying from 112, the bladder membrane peripheral portion 117, and the securing strand 160, thereby establishing a substantially airtight seal between the bladder membrane 114 and the underlying from 112. In an alternative embodiment, the groove receiver 170 is incorporated in the support structure 140 stand 142.

Figure 6:
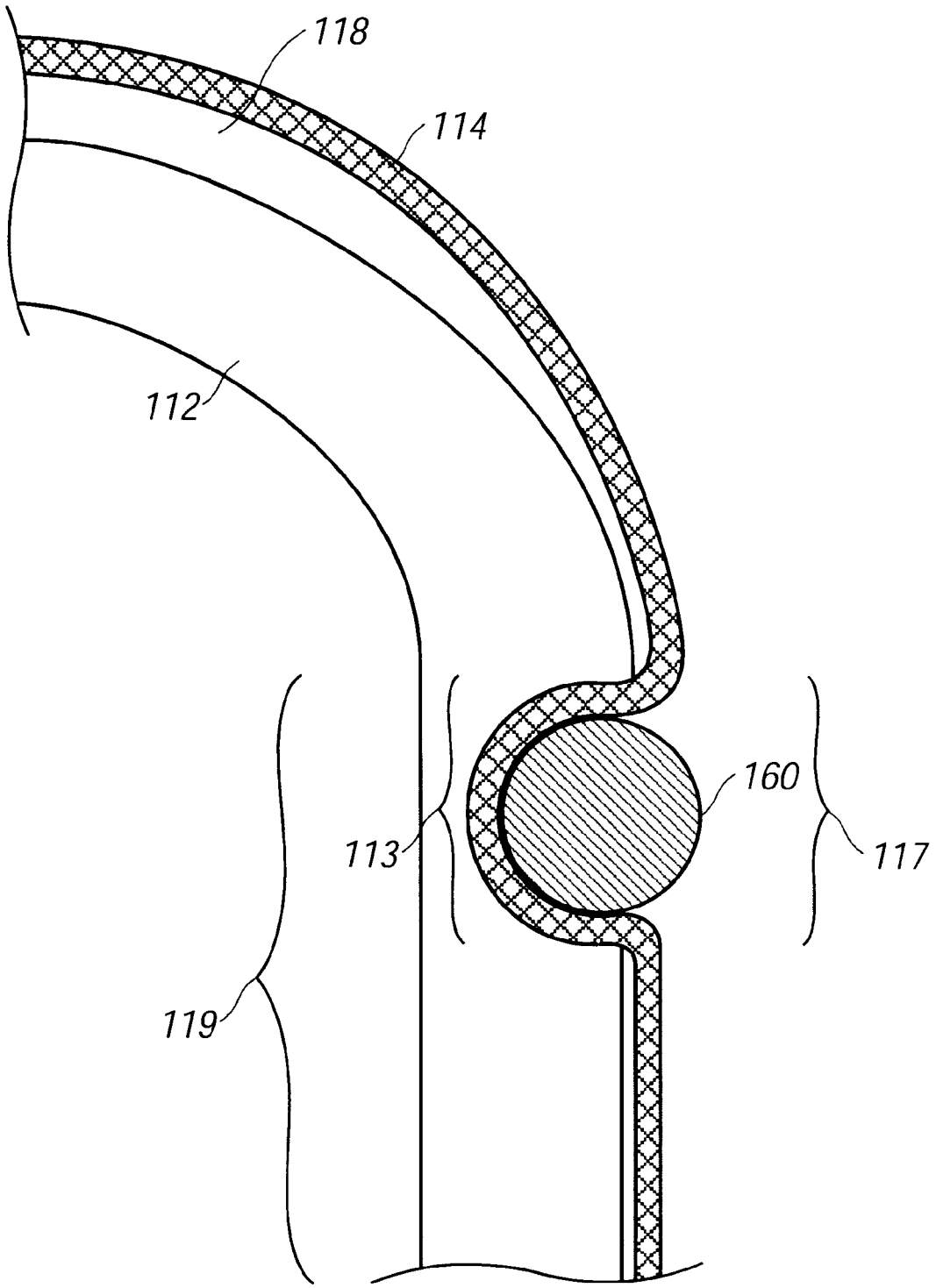
FIG. 6 is a schematic representation of a cross section detail of a preferred embodiment of the invention where the bladder membrane is secured to the underlying form using a securing strand and a receiving groove defined in the underlying form.

FIG. 6 illustrates another alternative for securing the bladder membrane 114 to the underlying from 112 to create a substantially airtight air receiving space 118. In this embodiment, a underlying form receiving groove 113 is defined in the underlying form peripheral portion 119. The bladder membrane 114 is positioned over the underlying from 112 so that a bladder membrane peripheral portion 117 extends beyond the underlying form receiving groove 113. A securing strand 160 is configured to fit snugly within the underlying form receiving groove 113 with the bladder membrane peripheral portion 117 interposed and frictionally and compressively secured between the securing strand 160 and the underlying form receiving groove 113; thereby establishing a substantially airtight receiving space between the bladder membrane 114 and the underlying from 112.

In a further alternative embodiment, the bladder assembly 110 includes a non-inflatable underlying from 112 and a separately inflatable overlying bladder. In this embodiment, the overlying bladder is configured to form a substantially conformal fit atop the underlying from 112 when the overlying bladder is deflated. The underlying from 112 and overlying bladder are releasably connected so that the overlying bladder is positioned between the underlying from 112 and an interior of the hat 200 to be shaped. The inflation assembly 120 is adapted to selectively input air pressure into to the overlying bladder and release air pressure from the overlying bladder thereby facilitating retention of the shape of the hat 200 in the manner described above.

A hat shaping arrangement 100 and its components have been described herein. These and other variations, which those skilled in the art will appreciate, are within the intended scope of this invention as claimed below. As previously stated, detailed embodiments of the present invention are disclosed herein; however, it is to be understood that the disclosed embodiments are merely exemplary of the invention that they may embody in various forms.

INDUSTRIAL APPLICABILITY: The present invention finds applicability in wearing apparel maintenance industries.

What is claimed and desired to be secured by Letters Patent is as follows:

1. A hat shaping arrangement comprising an inflation assembly; and an inflatable bladder assembly comprising an underlying form and an overlying bladder membrane; said bladder assembly having two end states consisting of a deflated end state and a fully inflated end state; said bladder assembly having a continuum of inflated states between said end states; and said bladder assembly having an air port defined therein wherein:

said underlying form is configured to substantially conform to an interior circumference of a hat to be shaped;

said overlying bladder membrane is adapted to form a substantially conformal fit about said underlying form when said bladder assembly is in said deflated end state;

said underlying form and said bladder membrane are releasably connected to each other to define an air receiving space there between; said air receiving space is substantially airtight other than at said air port;

said inflation assembly is in fluid communication with said air receiving space through said air port; and said inflation assembly adapted to selectively:

input air pressure to said air receiving space through said air port to extend said bladder membrane toward conformance with the hat to be shaped; and release air pressure from said air receiving space through said air port to allow said bladder membrane to retract away from conformance with the hat to be shaped;

thereby facilitating the retention of the shape of the hat while the hat dries.

2. The hat shaping arrangement as recited in claim 1 wherein said underlying form is constructed from semi-rigid plastic which is semi-yielding for avoiding puncture damage to said overlying bladder membrane.

3. The hat shaping arrangement as recited in claim 2 wherein said underlying form is substantially dome-shaped.

4. The hat shaping arrangement as recited in claim 1 wherein said overlying bladder is constructed from elastic material capable of stretching between said inflated and said deflated end states.

5. The hat shaping arrangement as recited in claim 1 wherein said inflation assembly comprises a manual inflation device.

6. The hat shaping arrangement as recited in claim 5 further comprising a conduit fluidly connected and interposed between said manual inflation device and said air receiving space.

7. The hat shaping arrangement as recited in claim 5 wherein said manual inflation device comprises a piston and cylinder arrangement adapted to be manually reciprocated to pump air into said air receiving space.

8. The hat shaping arrangement as recited in claim 7 further comprising a conduit fluidly connected and interposed between said manual inflation device and said air receiving space.

9. The hat shaping arrangement as recited in claim 1 further comprising a pressure relief valve fluidly connected to said air receiving space for releasing air pressure out of said air receiving space, thereby accommodating transformation of said bladder assembly from one of said inflated states toward said deflated end state.

10. The hat shaping arrangement as recited in claim 9 wherein:

said pressure relief valve further comprises a rotatable valve member, and said rotatable valve member is adapted to move said pressure relief valve between open and closed states by rotation of said rotatable valve member.

11. The hat shaping arrangement as recited in claim 1 further comprising at least one securing clip configured for releasably securing the hat to be shaped on said hat shaping arrangement.

12. The hat shaping arrangement as recited in claim 11 wherein said at least one securing clip releasably secures a bill of the hat to be shaped on said hat shaping arrangement.

13. The hat shaping arrangement as recited in claim 12 wherein said securing clip comprises at least one operating member adapted to transition said securing clip between open and closed configurations.

14. The hat shaping arrangement as recited in claim 12 wherein:

said securing clip is primarily constructed from plastic; and said securing clip comprises a spring arranged for biasing said securing clip toward a closed configuration.

15. The hat shaping arrangement as recited in claim 1 further comprising a support structure adapted to support said bladder assembly.

16. The hat shaping arrangement as recited in claim 15 wherein said support structure comprises a base.

17. The hat shaping arrangement as recited in claim 16 wherein said base is adapted to also support said inflation assembly.

18. The hat shaping arrangement as recited in claim 15 wherein:

said support structure comprises a brace bar and a stand;

said brace bar extends from a first interior side of said underlying form to a second interior side of said underlying form in the manner of a chord;

said stand extends from said brace bar;

said stand comprising at least one foot portion.

19. The hat shaping arrangement as recited in claim 18 wherein said support structure further comprises a clip-style inflation assembly receiving portion adapted to support said inflation assembly.

20. The hat shaping arrangement as recited in claim 1 further comprising an elongate securing strand; wherein:

said underlying form has an underlying form peripheral portion with a receiving groove defined there along, said overlying bladder membrane has a bladder membrane peripheral portion; and said securing strand is configured to fit snugly within said receiving groove with said bladder membrane peripheral portion interposed and frictionally and compressively secured between said securing strand and said receiving groove thereby establishing a substantially airtight seal between said bladder membrane and said underlying form.

21. The hat shaping arrangement as recited in claim 1 further comprising an elongate securing strand, and a groove receiver wherein:

said underlying form has an underlying form edge, and an underlying form peripheral portion;

said overlying bladder membrane has a bladder membrane peripheral portion; and said bladder membrane peripheral portion is in contact with said underlying form peripheral portion and extends beyond said underlying form edge toward an interior of said underlying form;

said receiving groove is adapted to snugly contain said underlying form edge, said bladder membrane peripheral portion, and said securing strand, thereby establishing a substantially airtight seal between said bladder membrane and said underlying form.

22. A hat shaping arrangement comprising:

an inflation assembly and a bladder assembly comprising an underlying form and an inflatable overlying bladder defining a substantially airtight air receiving space therein; said overlying bladder having an air port defined therein; and said overlying bladder having two end states comprising a deflated end state and a fully inflated end state and having a continuum of inflated states between said end states; and wherein:

said underlying form is configured to substantially conform to an interior circumference of a hat to be shaped;

said overlying bladder is configured to form a substantially conformal fit atop said underlying form when said overlying bladder is in said deflated end state;

said underlying form and said overlying bladder are releasably connected so that said overlying bladder is positioned between said underlying form and an interior of the hat to be shaped;

said inflation assembly is in fluid communication with said air receiving space through said air port; and said inflation assembly is adapted to selectively:

input air pressure to said air receiving space through said air port to extend said overlying bladder toward conformance with the interior of the hat to be shaped; and release air pressure from said air receiving space through said air port to allowing said overlying bladder to retract away from conformance with the interior of the hat to be shaped;

thereby facilitating retention of the shape of the hat while the hat dries.

* * * * *